US006951434B2

(12) United States Patent
Yodock, Jr. et al.

(10) Patent No.: US 6,951,434 B2
(45) Date of Patent: Oct. 4, 2005

(54) TRAFFIC CONTROL DEVICE

(76) Inventors: Leo J. Yodock, Jr., 1517 SW. 17th St., Fort Lauderdale, FL (US) 33315; Leo J. Yodock, III, 2832 Cleveland St., Hollywood, FL (US) 33020; Guy C. Yodock, 1517 SW. 17th St., Fort Lauderdale, FL (US) 33315

( * ) Notice: Subject to any disclaimer, the term of this patent is extended or adjusted under 35 U.S.C. 154(b) by 228 days.

(21) Appl. No.: 10/349,547

(22) Filed: Jan. 21, 2003

(65) Prior Publication Data

US 2004/0141807 A1 Jul. 22, 2004

(51) Int. Cl.[7] ..... E01F 13/00
(52) U.S. Cl. ..... 404/6; 404/9
(58) Field of Search ..... 404/6, 9; 256/1, 256/13.1; 248/466; 40/612, 584; D20/29, 10

(56) References Cited

U.S. PATENT DOCUMENTS

| | | | | | |
|---|---|---|---|---|---|
| 4,059,362 | A | | 11/1977 | Smith | 404/6 |
| 4,309,836 | A | * | 1/1982 | Knapp | 40/602 |
| 4,391,077 | A | | 7/1983 | Giess | 52/747 |
| 4,524,533 | A | * | 6/1985 | Still, Jr. | 40/607.06 |
| 4,681,302 | A | | 7/1987 | Thompson | 256/13.1 |
| 4,773,629 | A | | 9/1988 | Yodock | 256/13.1 |
| 4,946,306 | A | | 8/1990 | Yodock | 404/6 |
| 4,954,009 | A | * | 9/1990 | Kellison | 404/6 |
| 5,123,773 | A | | 6/1992 | Yodock | 404/6 |
| 5,186,438 | A | * | 2/1993 | Cross et al. | 256/13.1 |
| 5,208,585 | A | * | 5/1993 | Sprague | 340/908.1 |
| 5,498,101 | A | | 3/1996 | Braverman | 404/6 |
| 5,531,540 | A | | 7/1996 | Wasserstrom et al. | 404/6 |
| 5,605,413 | A | | 2/1997 | Brown | 404/6 |
| 5,836,714 | A | * | 11/1998 | Christensen | 404/6 |
| 5,882,140 | A | | 3/1999 | Yodock, Jr. et al. | 404/6 |
| 6,086,285 | A | * | 7/2000 | Christensen | 404/6 |

FOREIGN PATENT DOCUMENTS

| | | | | |
|---|---|---|---|---|
| FR | 2676762 A1 | * | 11/1992 | E01F/9/01 |
| JP | 2000178926 A | * | 6/2000 | E01F/7/06 |

* cited by examiner

*Primary Examiner*—Gary S Hartmann
(74) *Attorney, Agent, or Firm*—Holland & Knight LLP

(57) ABSTRACT

A traffic control device is provided including at least one barrier unit comprising a top wall formed with at least two openings, a bottom wall having post boots which align with the openings in the top wall, opposed end walls, and, opposed side walls interconnected to form a hollow interior. A post is releasably inserted into the hollow interior of the barrier unit through each opening in its top wall so that an inner portion of each post is received within an aligning post boot on the bottom wall. An outer portion of the posts protrude from the top wall of the barrier unit and support horizontally oriented pannel, the uppermost one of which mounts a sign.

13 Claims, 5 Drawing Sheets

TRAFFIC CONTROL DEVICE

FIELD OF THE INVENTION

This invention relates to devices for vehicular traffic control and, more particularly, to a traffic control device including a barrier unit formed of a light weight plastic having a hollow interior within which first and second posts are removably mounted. An outer portion of each post which protrudes from the hollow interior mounts three vertically spaced panels, the uppermost one of which supports a sign such that upon impact of the barrier unit by a vehicle the uppermost panel and sign detach from the posts and avoid impact with the vehicle.

BACKGROUND OF THE INVENTION

A variety of devices have been developed for absorbing the kinetic energy of impact of colliding vehicles, to control the flow and direction of traffic and to identify areas of restricted access for pedestrian or vehicular traffic. Highway barrier devices, for example, have been used in each of the applications noted above. One commonly used highway barrier, formed entirely of pre-cast reinforced concrete, is known as the "New Jersey" style barrier. Highway barriers of this type have a relatively wide base including side walls which extend vertically upwardly from ground level a short distance, then angle inwardly and upwardly to a vertically extending portion connected to the top wall of the barrier. See U.S. Pat. No. 4,059,362.

One problem with highway barriers of the type described above is the high weight of reinforced concrete. A barrier having a typical length of twelve feet weighs about 2,800–3,200 pounds and requires special equipment to load, unload and handle on site. It has been estimated that for some road repairs, up to 40 percent of the total cost is expended on acquiring, delivering and handling concrete barriers. Additionally, concrete barriers have little or no ability to absorb shock upon impact, and have a high friction factor. This increases the damage to vehicles which collide with such barriers, and can lead to serious injuries to passengers of the vehicles.

In an effort to reduce weight, facilitate handling and shipment, and provide improved absorption of impact forces, highway barriers have been designed which are formed of a hollow plastic container filled with water, sand or other ballast material such as disclosed in U.S. Pat. Nos. 4,681,302; 4,773,629; 4,846,306, 5,123,773 and 5,882,140. For example, the '302 patent discloses a barrier comprising a container including a top wall, bottom wall, opposed side walls and opposed end walls interconnected to form a hollow interior which is filled with water or other ballast material, and has fittings for coupling one barrier to another to form a continuous wall. The container structure is formed of a resilient material which is deformable upon impact and capable of resuming its original shape after being struck.

One application of interest for the concrete and plastic barrier devices described above is what is known as a "Type III" barrier used primarily to mount signs which identify areas of restricted access to vehicles or pedestrians, or to otherwise provide indicia of traffic or road conditions. In applications of this type, one or more vertical supports are mounted at the top of the barrier typically by a bracket which rests on the top wall of the barrier and straddles the two side walls. The vertical supports or posts usually mount three vertically spaced panels in position above the top wall of the barrier. A sign is connected to one of the panels in position to be readily viewed by motorists and pedestrians.

It is not uncommon for vehicles to strike "Type III" barriers since they may be placed, for example, in the middle of a road with the sign "Road Closed." As noted above, concrete highway barriers have little or no ability to absorb the shock of a vehicle impact. In fact, vehicles tend to "ramp up" or move upwardly along a concrete barrier upon impact. If moving fast enough at impact, the vehicle can become airborne thus causing potentially serious injury to the occupants of the vehicle Although plastic highway barriers filled with a ballast material are much more resilient and absorbent to impact shock, they often break apart when struck by a vehicle and allow the sign and/or one or more panels to strike the windshield or other part of the vehicle and penetrate the passenger compartment. This places the vehicle's occupants at risk of injury from flying debris after impact.

SUMMARY OF THE INVENTION

It is therefore among the objectives of this invention to provide a traffic control device for use as a Type III barrier which is easy to assemble, which prominently mounts signs of all types and which protects motorists from contact with such signs in the event of impact by a vehicle.

These objectives are accomplished in a traffic control device which includes a barrier unit comprising a top wall formed with at least two openings, a bottom wall having at least two post boots which align with the openings in the top wall, opposed end walls, and, opposed side walls interconnected to form a hollow interior. A post is inserted into the hollow interior through each opening in the top wall and its bottom end is received within an aligning post boot on the bottom wall. An outer portion of the posts protrude from the top wall of the barrier unit and support horizontally oriented panels, the uppermost one of which mounts a sign.

This invention is predicated on the concept of providing a Type III barrier which minimizes the danger to motorists in the event of vehicular impact with the barrier. In the presently preferred embodiment, a top panel, a bottom panel and all intermediate panel located between the two are vertically spaced along the upper portion of a first post and a second post which protrude from the barrier unit. Each panel is mounted to the first and second posts by a U-bolt or other connector, and, in order to orient the panels in a straight horizontal line between the two posts, a set screw or the like is mounted to each post in position to contact one of the U-bolts. Consequently, the opposed ends of each panel rest atop a set screw and are mounted by a U-bolt to one of the first and second posts.

In the event the barrier unit is impacted by a vehicle, the force of the blow drives the barrier unit in the same direction of movement of the vehicle. Unlike concrete barriers, the barrier unit herein tends to maintain the front of the vehicle on the ground after impact allowing the driver to maintain control. Movement of the barrier unit with the vehicle causes the two posts to move in the opposite direction, and even though connected by U-bolts to the posts, the top panel and the sign it supports separate from the posts. The momentum of the vehicle carriers it underneath and past the separated top panel and sign so that neither impact the vehicle, thus protecting its occupants. In most instances, the two posts and remaining two panels also pass over the vehicle and avoid impact with it. The intermediate and bottom panel remain engaged with the posts because the set screws upon which the top panel and intermediate panel originally rested prevent the U-bolts of the intermediate panel and bottom panel, respectively, from sliding off of the posts, i.e. the U-bolts of the intermediate panel contact the set screws for the top panel, and the U-bolts supporting the bottom panel contact the set screws for the intermediate panel.

Unlike Type III barriers employing concrete barriers or prior plastic barriers, the traffic control device of this invention effectively prevents the sign, panels and support posts from contacting the windshield, roof, side windows or other parts of the vehicle where they might enter the passenger compartment and injure its occupants.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1:
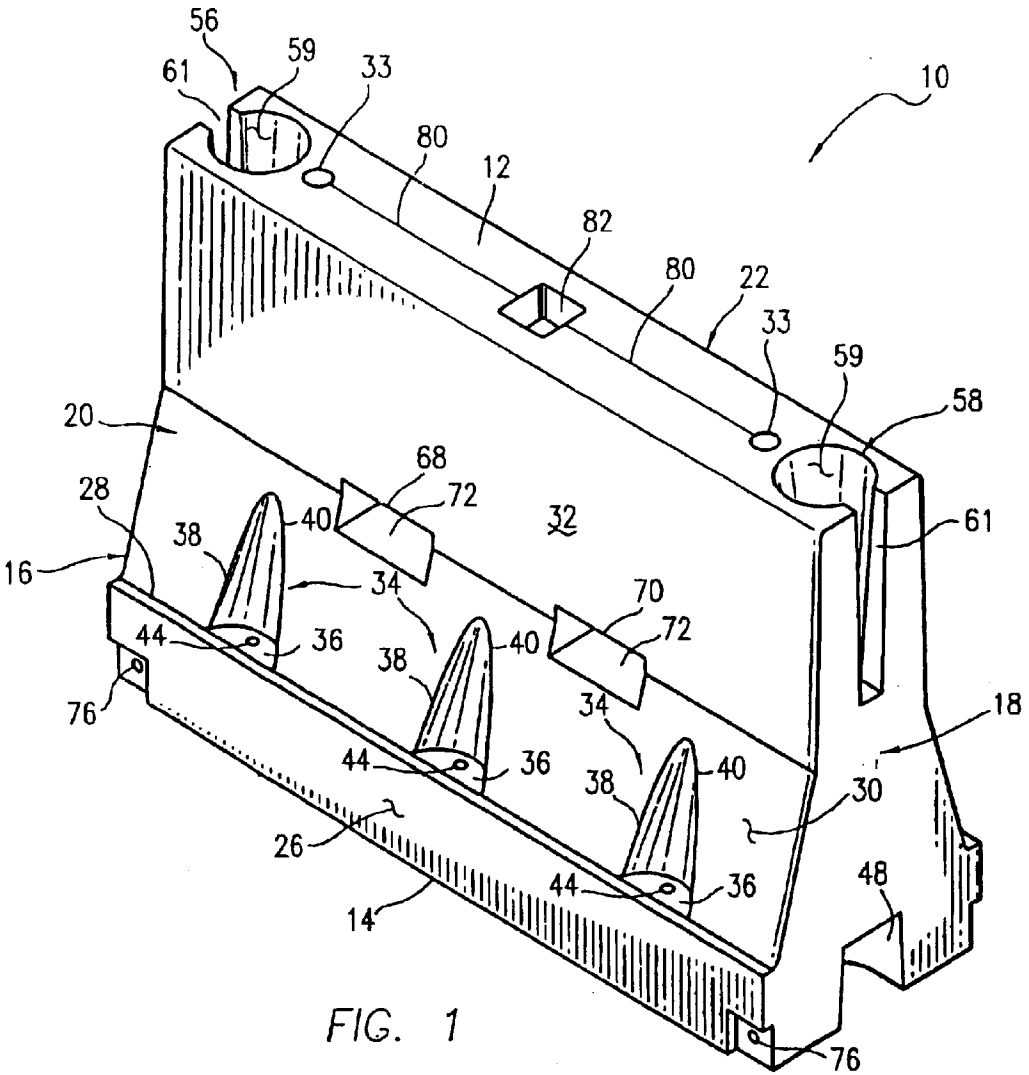
FIG. 1 is a perspective view of the barrier unit of the traffic control device of this invention.
Figure 2:
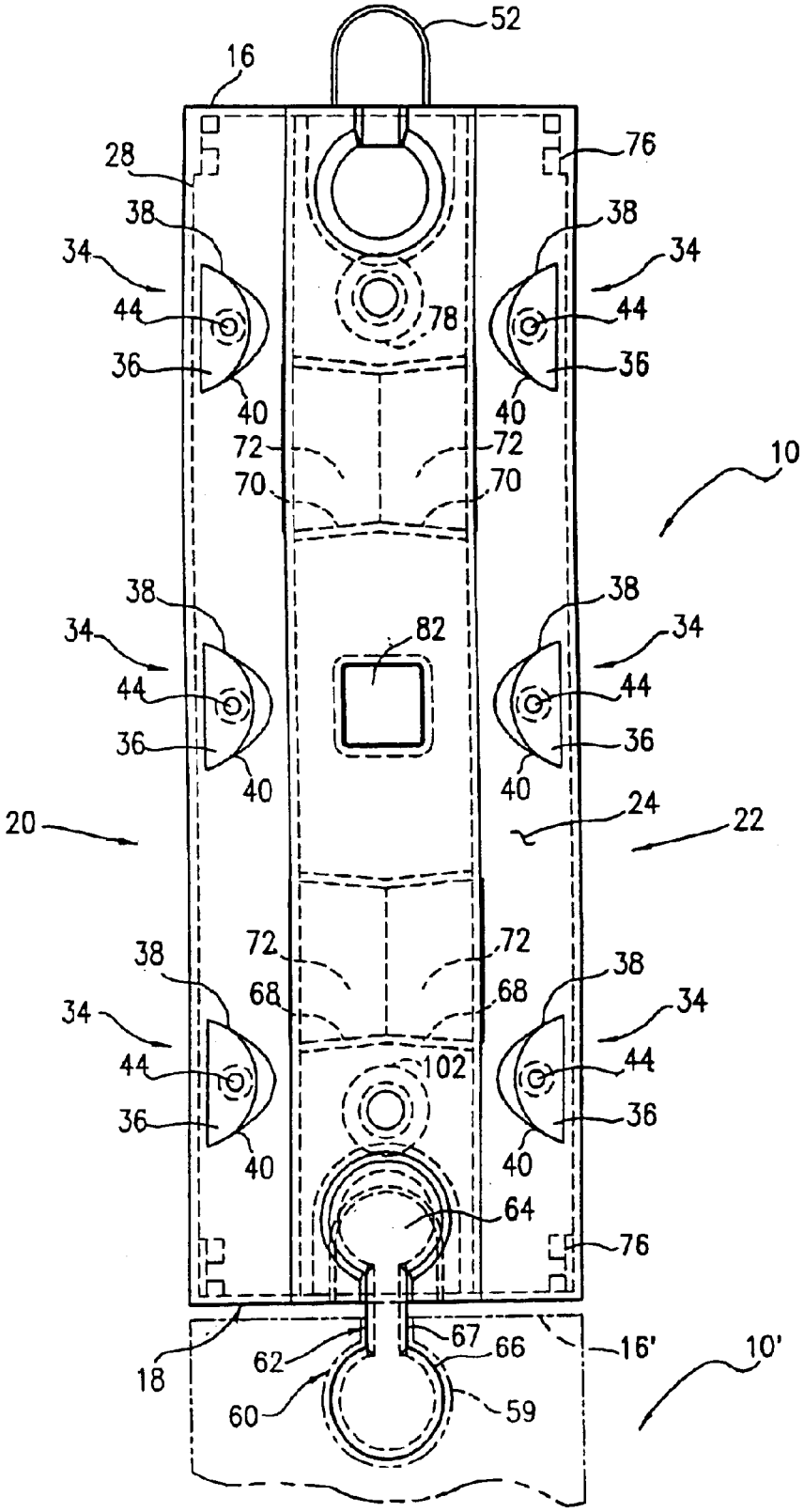
FIG. 2 is a plan view of the barrier unit depicted in FIG. 1, with a second barrier unit shown in phantom at one end.
Figure 5:
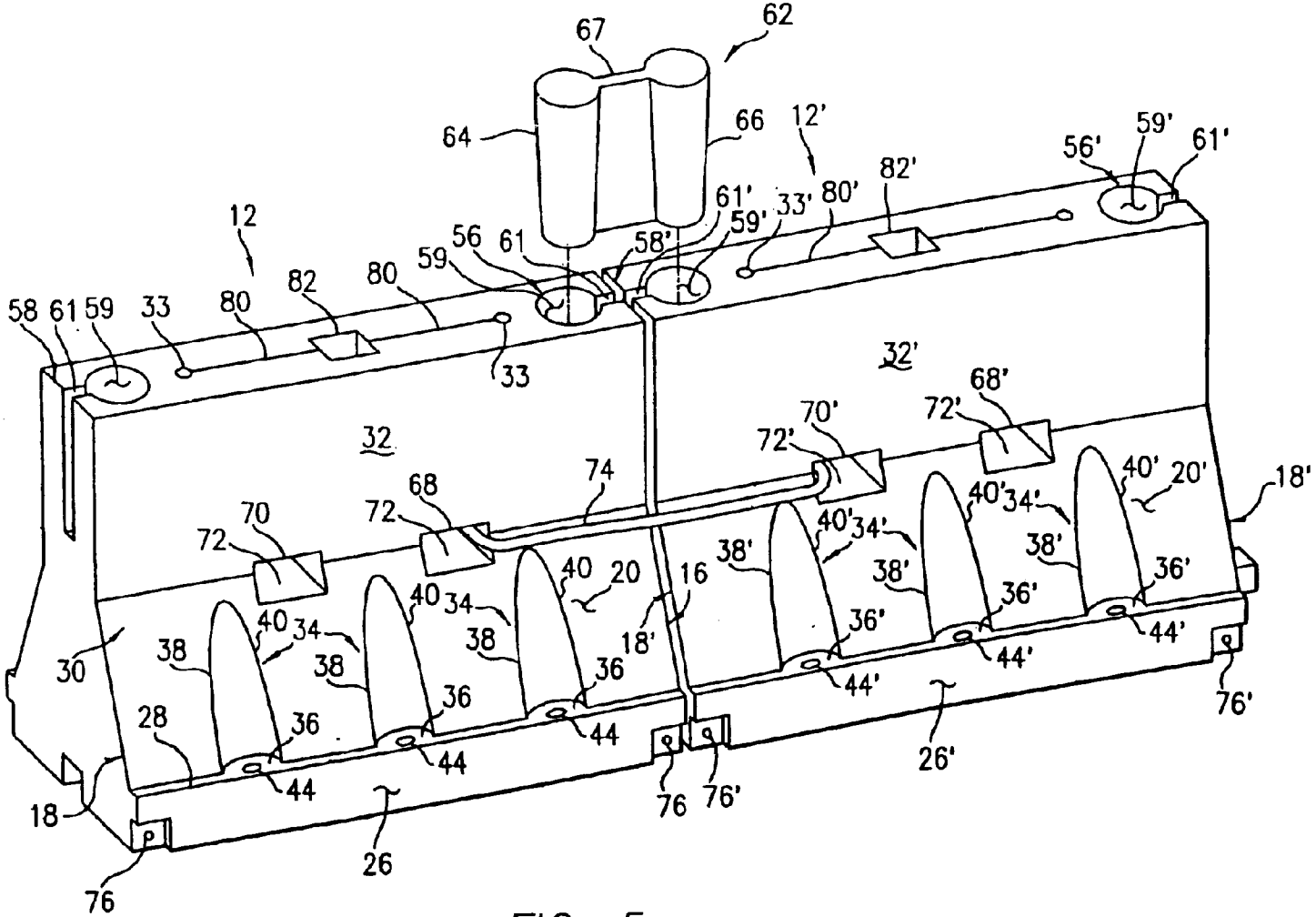
FIG. 5 is perspective view of two barrier units connected together, one or both of which may include the posts, panels and sign(s) as shown in FIGS. 3 and 4.

Referring initially to FIGS. 1, 2 and 5, the traffic control device of this invention includes one or more barrier units 10 each comprising a top wall 12, a bottom wall 14, opposed end walls 16, 18, and, opposed side walls 20, 22 which are interconnected to collectively define a hollow interior 24. In the presently preferred embodiment, each of the walls 12–22 are formed of a semi-rigid plastic material chosen from the group consisting of low density polyethylene, acrylonitrile or butadiene styrene, high impact styrene, polycarbonates and the like. These plastic materials are all inherently tough and exhibit good energy absorption characteristics. They will also deform and elongate, but will not fail in a brittle manner at energy inputs which cause other materials to undergo brittle failure. The surfaces of these types of plastic materials are inherently smoother than materials from which other barriers are typically constructed, therefore creating less friction and reducing the likelihood of serious abrasion injuries to vehicles and/or passengers who may come into contact therewith. Additionally, materials of this type are unaffected by weather and have excellent basic resistance to weathering, leaching and biodegradation. Additives such as ultraviolet inhibitors can be added thereto, making such materials further resistant to the effects of weather. They also retain their mechanical and chemical properties at low ambient temperatures.

When using the barrier unit 10 of this invention as a Type III barrier, the hollow interior 24 is preferably at least partially filled with a "ballast" material such as water or other liquid, or a flowable solid material such as sand, concrete and the like. For this purpose, the walls 12–22 of barrier unit 10 have a thickness in the range of about one-eighth inch to one inch so as to perform satisfactorily in service. The barrier unit 10 is preferably in the range of about two to eight feet in length, and, at the wall thickness noted above, has a weight when empty of about 30 to 140 lbs. When completely filled with a liquid such as water, the overall weight of the barrier is in the range of about 2500 to 2200 lbs. Flowable solid material such as sand and the like increase the weight of barrier 10 further.

Each of the side walls 20 and 22 have the same construction, and therefore only side wall 20 is described in detail herein. In the presently preferred embodiment, the side wall 20 includes a substantially vertically extending curb reveal 26 which extends from the bottom wall 14 to a horizontally extending ledge or step 28 best shown in FIG. 1. Preferably, the curb reveal 26 has a vertical height of nine inches, measured from the bottom wall 14 upwardly, which is at least two inches greater than the curb reveals of other highway barrier devices, such as disclosed, for example, in U.S. Pat. No. 5,123,773. The horizontal extent of the step 28 is preferably on the order of about 1 ½ inches measured in the direction from the outer edge of curb reveal 26 toward the hollow interior 24 of barrier unit 10.

Extending upwardly at an acute angle from the step 28 is an intermediate section 30 which terminates at a vertically extending upper section 32. The upper section 32, in turn, extends from the intermediate section 30 to the top wall 12 of barrier 10 which is formed with a pair of fill holes 33 preferably having a diameter in the range of about 3–4 inches. In the presently preferred embodiment, a number of stabilizers 34 are integrally formed in the intermediate section 30, at regularly spaced intervals between the end walls 16, 18. Each stabilizer 34 includes a base 36 and opposed sides 38 and 40. As best seen in FIG. 1, the base 36 of each stabilizer 34 is coplanar with the step 28 and is supported by an internally located support (not shown). The sides 38, 40 of each stabilizer 34 taper inwardly, toward one another, from the base 36 to a point substantially coincident with the uppermost edge of intermediate section 30 where the upper section 32 of side wall 20 begins. In the presently preferred embodiment, a through bore 44 extends from the base 36 of one or more of the stabilizers 34, through the internal support and out the bottom wail 14 of barrier 10. One or more of these through bores 44 receive an anchoring device such as a stake (not shown) which can be driven into the ground or other surface upon which the barrier unit 10 rests to secure it in an essentially permanent position thereon.

As noted above, two or more barrier units 10 may be employed to form the traffic control device of this invention. For this purpose, the barrier units 10 include structure to mount them end-to-end and resist disengagement in the event of impact. Two barrier units 10 and 10' are depicted in FIGS. 2 and 5, which are identical in structure and function. The same reference numbers are therefore used to identify like structure, with the addition of a "'" to the numbers associated with barrier 10' on the right-hand side of FIG. 5.

Each end wall 16 of barrier unit 10 is formed with an internally extending recess 48 near the bottom wall 14, which receives an outwardly protruding extension 52 formed on the end wall 18 of an adjacent barrier unit 10. The upper portion of end wall 16 is formed with a slot 56, and the upper portion of end wall 18 is formed with a slot 58. Each slot 56, 58 has an inner, generally cylindrical-shaped portion 59 and a narrower, substantially rectangular-shaped portion 61 at their respective end walls 16, 18. The slots 56, 58 extend from the top wall 12 downwardly to a point near the juncture of the upper section 32 and intermediate section 30.

When two barrier units 10 and 10' are oriented end-to-end, with the end wall 16 of one barrier unit 10 abutting the end wall 18'of an adjacent barrier unit 10, the slots 56, 58 collectively form a barbell-shaped locking channel 60 shown in FIG. 5 and also depicted in phantom at the bottom of FIG. 2. This locking channel 60 receives a coupler 62 having cylindrical ends 64, 66 and a rectangular center section 67, which is removably insertable therein and extends substantially along the entire length of the locking channel 60. The cylindrical ends 64, 66 of coupler 62 pivot within the correspondingly shaped cylindrical portions 59, 59' of slots 56, 58', so that one barrier unit 10 can be pivoted with respect to an adjacent barrier unit 10'.

Additionally, a pair of hollow sleeves 68 and 70 are located within the hollow interior 24 of barrier unit 10 and extend between the side walls 20, 22. A portion of both sleeves 68, 70 is located in the intermediate section 30 of each side wall 20, 22, and extends partially into the upper sections 32 thereof. The two sleeves 68, 70 are positioned in the spaces between the three stabilizers 34 formed in the side walls 20, 22, and provide added internal support to the barrier unit 10 so that it retains its shape when filled with a ballast material.

Each of the sleeves 68 and 70 define a pass-through hole or channel 72 adapted to receive the tines of a forklift truck to permit handling of the barrier units 10. Moreover, a strap 74 (see FIG. 5) can be extended between the channel 72 of sleeve 68 in one barrier unit 10 and the channel 72 of sleeve 70' in an adjacent barrier unit 10', and then tightened down, to urge such barrier units 10, 10' together and provide additional resistance to disengagement of adjacent barrier units 10, 10'.

In the presently preferred embodiment, a drain hole 76 is formed along each of the end walls 18 and 20 thereof near the bottom wall 14 to allow passage of water and the like from one side of the barrier unit 10 to the other. Water or other flowable material is introduced into the hollow interior 24 of the barrier unit 10 via the fill holes 33 formed in top wall 12. Rainwater or the like which falls onto the top wall 12 is channeled into the fill holes 33 by recesses 80 formed along the top wall 12. Although not employed for use as a Type III barrier, the top wall 12 of barrier unit 10 is also formed with a seat 82 which can receive a warning light (not shown).

Figure 3:
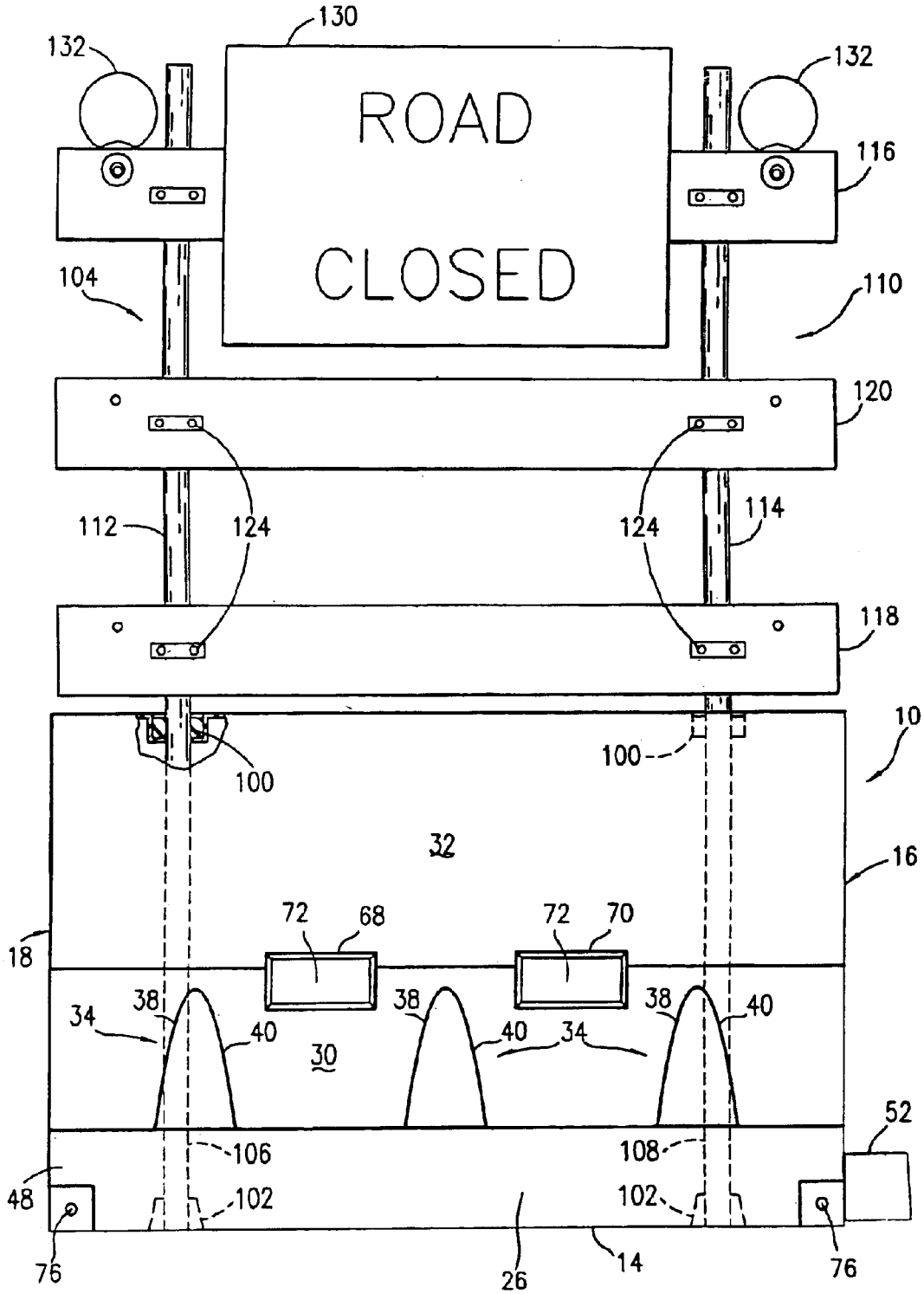
FIG. 3 is a front view of the traffic control device herein showing a barrier unit with posts, panels and a sign.
Figure 4:
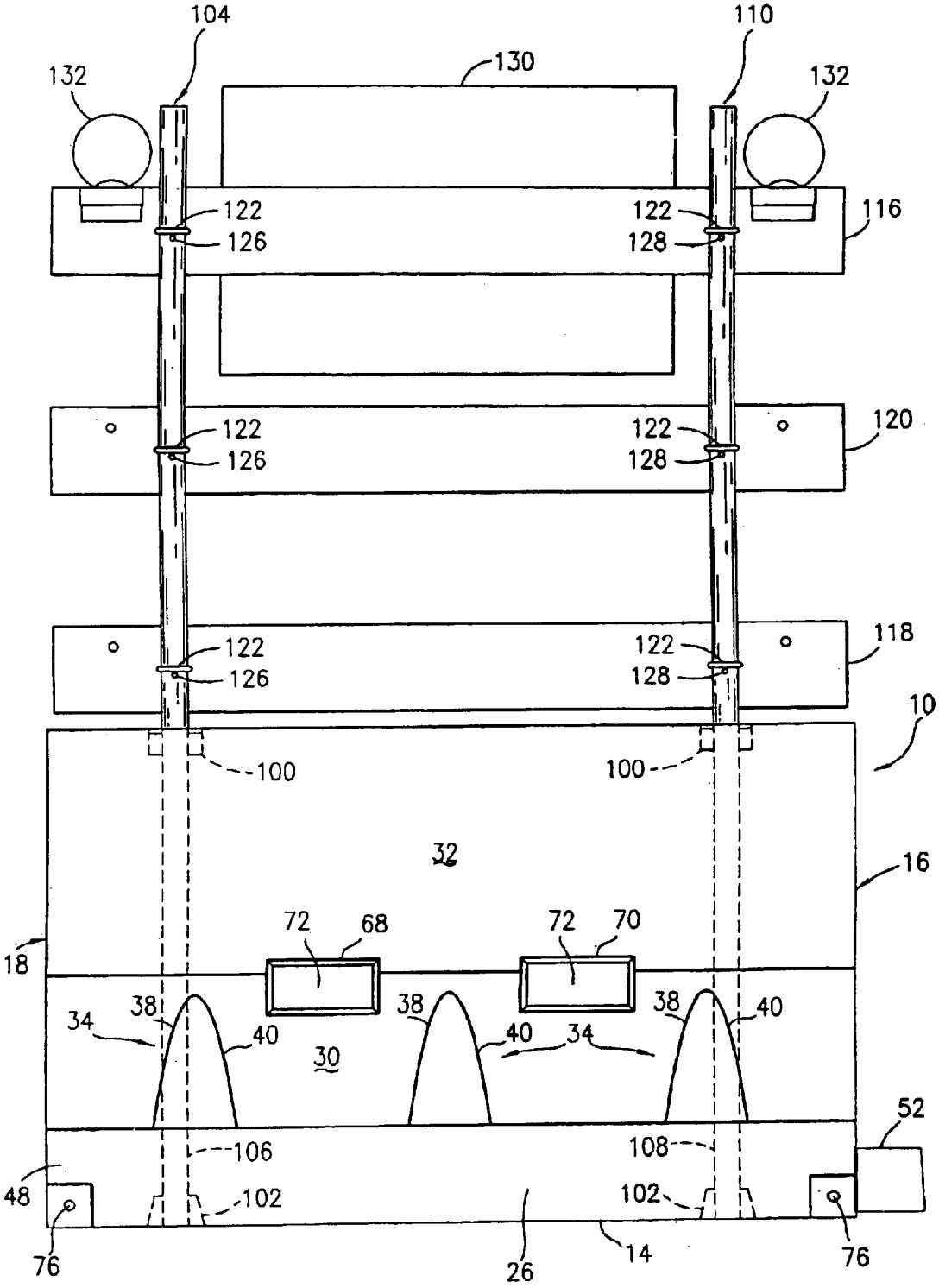
FIG. 4 is a rear view of FIG. 3.

With reference now to FIGS. 3 and 4, each barrier unit 10 (and 10') is capable of supporting structure which mounts one or more signs to notify pedestrians and/or motorists of a road condition or the like. In the presently preferred embodiment, each of the fill holes 33 formed in the top wall 12 of the barrier unit 10 receives a bushing 100 made of a resilient material such as rubber. A post boot 102 is formed in the bottom wall 14 of the barrier unit 10 in vertical alignment with each fill hole 33. A first post 104 is inserted through one fill hole 33 so that its lower end 106 seats within a post boot 102, and a second post boot 102 receives the lower end 108 of a second post 110 which is extended through the other fill hole 33 in the top wall 12. Preferably, each of the first and second posts 104, 110 are formed of hollow PVC pipe having a diameter of about 2 inches which snugly fits within the bushing 100 and post boot 102 so that they are securely held in a generally vertically orientation within the hollow interior 24 of the barrier unit 10.

As shown in FIGS. 3 and 4, with the posts 104 and 110 mounted within the barrier unit 10, an outer portion 112 of post 104 and an outer portion 114 of post 110 protrude from the top wall 12. The overall height of the posts 104 and 110 is approximately 96 inches or 8 feet, with about 46 inches of that total height being contained within the barrier unit 10 and the remaining 50 inches included in the height of the outer portions 112 and 114. These outer portions 112, 114 cooperate to mount a top panel 116, a bottom panel 118 and an intermediate panel 120 extending generally horizontally between the posts 104, 110. The panels 116, 118 and 120 are vertically spaced along the outer portions 112, 114 of posts 104 and 110, with the intermediate panel 120 being located between the top and bottom panels 116, 118. In the presently preferred embodiment, the ends of each panel 116, 118 and 120 are secured to a respective post 104 and 110 by a U-bolt 122 which wraps around the back of the posts 104, 110 (FIG. 4) and whose threaded ends are connected to nuts 124 at the front of the traffic control device (FIG. 3). Other fasteners may be used, as desired. Additionally, in order to assist in orienting the panels 116, 118 and 120 in a horizontal position on the posts 104, 110, set screws 126 are mounted to the first post 104 at vertically spaced intervals, and set screws 128 are mounted to the second post 110 in horizontal alignment with the set screws 126. As seen in FIG. 4, the U-bolts 122 connected at opposite ends of the top panel 116, for example, rest upon the aligning set screws 126 and 128 on the posts 104, 110, respectively. The same is true for the panels 118 and 120. This ensures that all three panels 116, 118 and 120 are evenly spaced from one another and generally horizontally oriented.

In the presently preferred embodiment, a sign 130 is mounted to the top panel 116 by screws or other fasteners (not shown) such as the "Road Closed" sign depicted in FIG. 3. Additionally, one or more flashing or constant light barricade lights 132 may be mounted to the top panel 116 as shown.

As noted above, the traffic control device of this invention is designed to prominently display sign 130 and also to substantially prevent injury to occupants of a vehicle which crash into the barrier unit 10. Upon impact of the traffic control device herein by a vehicle, the barrier unit 10 is immediately pushed in the direction of travel of the vehicle. The extent of movement of the barrier unit 10 is dependent on the amount and type of ballast material placed in its hollow interior 24, and whether one or more other barrier units 10' are connected end-to-end with the impacted barrier unit 10 in the manner described above. In most applications, it is preferable to partially fill the barrier unit 10 with ballast material such as water, e.g. on the order of about one-half to two thirds full, to allow for continued forward movement of the vehicle after impact with the barrier unit 10.

It has been found that the force of impact by the vehicle, and movement of the barrier unit 10 after impact, causes the top panel 116 and sign 130 to disengage from the posts 104, 110 and travel in a direction opposite to the direction of travel of the vehicle and barrier unit 10. Although the top panel 116 is connected by a U-bolt 122 to each post 104, 110, they are only about 6 to 12 inches from the outermost ends of the posts 104, 110 and will slide off upon impact of the vehicle Additionally, because the overall height of the posts 104 and 110 is about 8 feet, the roof of most vehicles is therefore located at least 2 feet below the top panel 116 which allows the sign 130 and top panel 116 to clear the vehicle as they move in opposite directions. This protects occupants of the vehicle from injury which could otherwise occur if the sign 130 and/or top panel 116 were allowed to contact the windshield, roof, side window or other part of the vehicle and penetrate the passenger compartment.

In many instances, depending on the force with which the vehicle impacts the barrier unit 10, both of the posts 104 and 110 disengage from the barrier unit 10. Unlike the top panel 116, the bottom panel 118 and intermediate panel 120 remain attached to the posts 104, 110 due their engagement with set screws 126 and 128. As best seen in FIG. 4, if the intermediate panel 120 begins to slide upwardly off of the posts 104, 110 it will contact the set screws 126 and 128 which support the U-bolts 122 of the top panel 116. Similarly, the set screws 126, 128 supporting the U-bolts 122 of the intermediate panel 120 block vertical movement of the bottom panel 118 along the posts 104, 110. As such, the posts 104, 110 and the panels 118, 120 collectively disengage from the barrier unit 110. In most instances, continued motion of the vehicle after contact with the barrier 10 allows it to clear these elements of the traffic control device before they land on any part of the vehicle which might result in penetration of the passenger compartment.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A traffic control device, comprising:

a barrier unit including a top wall, a bottom wall, opposed side walls and opposed end walls interconnected to form a hollow interior, said top wall being formed with at least two spaced openings;

a first post and a second post each having an inner portion and an outer portion, said inner portion of each of said first and second posts being inserted into said hollow interior of said barrier unit through one of said openings in said top wall;

a flexible bushing mounted at each of said openings in said top wall and a lower mounting device mounted to said bottom wall in alignment with one of said flexible bushings, said inner portion of one of said first and second posts slidably engaging one of said flexible bushings upon insertion into said hollow interior and seating on said aligning lower mounting device, said aligning flexible bushings and lower mounting devices releasably holding said first and second posts within said hollow interior of said barrier unit with said outer portion protruding from said top wall;

a sign mounted to said outer portion of said first and second posts of said barrier unit, said aligning pairs of upper and lower mounting devices permitting disengagement of said first and second posts and said sign from said barrier unit upon impact with a vehicle so that said sign substantially avoids contact with the vehicle.

2. The traffic control device of claim 1 in which each of said lower mounting devices formed in said bottom wall of said barrier unit is a post boot, said post boot having a wall forming an open interior defining a seat which receives one end of said inner position of said first or second post.

3. The traffic control device of claim 1 in which a first locator device is mounted to said first post and a second locator device is mounted to said second post generally horizontally relative to said first locator device, a panel being located atop said first and second locator devices and being mounted to said first and second posts said sign being mounted to said panel.

4. The traffic control device of claim 3 in which said first and second locator devices are set screws.

5. A traffic control device, comprising:

a barrier unit including a top wall, a bottom wall, opposed side walls and opposed end walls interconnected to form a hollow interior, said top wall being formed with at least two spaced openings;

a first post and a second post each having an inner portion and an outer portion, said inner portion of each of said first and second posts being inserted into said hollow interior of said barrier unit through one of said openings in said top wall, said first and second posts each being releasably held in a generally vertical orientation within said hollow interior of said barrier unit with said outer portion protruding from said top wall;

a first pair, a second pair and a third pair of locator devices, said first, second and third pairs each having one locator device mounted to said outer portion of said first post and a second locator device mounted to said outer portion of said second post in general horizontal alignment with said one locator device, said first, second and third pairs of locator devices being vertically spaced from one another along said outer portion of each of said first and second posts;

a first panel positioned atop said first pair of locator devices and mounted to said first and second posts, a second panel positioned atop said second pair of locator devices, beneath said first locator devices, and being mounted to said first and second posts, a third panel positioned atop said third pair of locator devices, beneath said second pair of locator devices, and being mounted to said first and second posts;

a sign mounted to said first panel, whereby upon impact of said barrier unit with a vehicle said sign and said first panel disengage from said first and second posts and substantially avoid contact with the vehicle while said second and third panels are prevented from disengaging said posts by said first and second locator devices, respectively.

6. The traffic control device of claim 5 in which each of said first, second and third pairs of locator devices extend outwardly from said first and second posts, said first and second sets of locator devices contacting said second and third panels, respectively, upon impact of said barrier unit with a vehicle to prevent disengagement of said second and third panels from said posts.

7. The traffic control device of claim 5 in which each of said upper mounting devices is a flexible bushing mounted within one of said openings in said top wall of said barrier unit, each of said flexible bushings slidably engaging one of said first and second posts upon insertion of said inner portion thereof through said flexible bushings to said bottom wall of said hollow interior.

8. The traffic control device of claim 5 in which each of said lower mounting devices formed in said bottom wall of said barrier unit is a post boot, said post boot having a wall forming an open interior defining a seat which receives one end of said inner portion of said first or second post.

9. The traffic control device of claim 7 in which said locator devices are set screws.

10. A traffic control device, comprising:

a first barrier unit and a second barrier unit, each of said first and second barrier units including a top wall, a bottom wall, opposed side walls and opposed end walls interconnected to form a hollow interior, said top wall of at least one of said first and second barrier units being formed with at least two spaced openings, said first and second barrier units being releasably coupled together end-to-end;

a first post and a second post each having an inner portion and an outer portion, said inner portion of each of said first and second posts being inserted into said hollow interior of one of said first and second barrier units through one of said openings in said top wall thereof;

a flexible bushing mounted at each of said openings in said top wall of at least one of said first and second barrier units and a lower mounting device mounted to said bottom wall of at least one of said first and second barrier units in alignment with one of said flexible bushings, said inner portion of one of said first and second posts slidably engaging one of said flexible bushings upon insertion into said hollow interior and seating on said aligning lower mounting device, said aligning flexible bushings and lower mounting device releasably holding said first and second posts within said hollow interior of at least one of said first and second barrier units with said outer portion protruding from said top wall;

a sign mounted to said outer portion of said first and second posts, said first and second posts and said aligning pairs of upper and lower mounting devices permitting disengagement of said sign from said one barrier unit upon impact with a vehicle so that said sign substantially avoids impact with the vehicle.

11. The traffic control device of claim 10 in which each of said lower mounting devices is formed in said bottom wall of at least said one barrier unit is a post boot, said post boot having a wall forming an open interior defining a seat which receives one end of said inner portion of said first or second post.

12. The traffic control device of claim 10 in which a first locator device is mounted to said first post and a second locator device is mounted to said second post generally horizontally relative to said first locator device, a panel being located atop said first and second locator devices and being mounted to said first and second post, said sign being mounted to said panel.

13. The traffic control device of claim 12 in which said first and second locator devices are set screws.

* * * * *